US007828903B2

(12) United States Patent
Wentworth

(10) Patent No.: US 7,828,903 B2
(45) Date of Patent: Nov. 9, 2010

(54) METHOD AND APPARATUS FOR REMOVING TUBERCULATION FROM SANITARY WATER PIPELINES

(75) Inventor: Steven W. Wentworth, Brookfield, WI (US)

(73) Assignee: Earth Tool Company LLC, Oconomowoc, WI (US)

( * ) Notice: Subject to any disclaimer, the term of this patent is extended or adjusted under 35 U.S.C. 154(b) by 294 days.

(21) Appl. No.: 11/804,623

(22) Filed: May 18, 2007

(65) Prior Publication Data

US 2007/0272276 A1 Nov. 29, 2007

Related U.S. Application Data

(60) Provisional application No. 60/801,367, filed on May 18, 2006.

(51) Int. Cl.

| | |
|---|---|
| ***B08B 9/027*** | (2006.01) |
| ***B08B 9/04*** | (2006.01) |
| ***B08B 9/045*** | (2006.01) |
| ***B08B 9/055*** | (2006.01) |

(52) U.S. Cl. ..... 134/8; 134/22.11; 134/22.12; 134/22.18; 134/34; 134/42

(58) Field of Classification Search ..... 134/22.12, 134/166 C

See application file for complete search history.

(56) References Cited

U.S. PATENT DOCUMENTS

| | | | | |
|---|---|---|---|---|
| 1,908,339 | A * | 5/1933 | Frank | 15/104.061 |
| 1,929,650 | A * | 10/1933 | Randall et al. | 15/104.07 |
| 5,104,595 | A | 4/1992 | Hunter | 264/33 |
| 5,885,364 | A * | 3/1999 | Hieatt et al. | 134/22.11 |
| 5,915,395 | A * | 6/1999 | Smith | 134/22.12 |
| 6,792,820 | B2 | 9/2004 | Wentworth et al. | 73/865.8 |
| 7,025,142 | B2 | 4/2006 | Crawford | 166/311 |
| 2002/0162406 | A1 * | 11/2002 | Wentworth et al. | 73/865.8 |
| 2004/0006448 | A1 * | 1/2004 | Penza | 702/183 |
| 2004/0118565 | A1 * | 6/2004 | Crawford | 166/312 |

OTHER PUBLICATIONS

"Cempipe, Ltd.," "Creating a Middle Ground in Waterline Rehabilitation," Nick Aubko, www.cempipe.com, May 18, 2007, 5 pages.

* cited by examiner

*Primary Examiner*—Michael Kornakov
*Assistant Examiner*—Natasha Campbell
(74) *Attorney, Agent, or Firm*—Tomlinson Rust McKinstry Grable

(57) ABSTRACT

A method for removing pipe tuberculation includes the initial step of preparing an access point in the existing pipe by digging to the pipe and sawing a section from the pipe or creating an access port. The section of the pipeline to have its tuberculation removed is isolated by closing valves or creating another access point and sealing the end. Then, a reaming tool is introduced to the interior of the pipe. The reaming tool is attached to a hollow rod string capable of producing moderate thrust and pullback force, and must also produce sufficient torque when rotated. A horizontal directional drilling or "HDD" machine on the surface or in a pit dug out for this purpose applies the aforementioned forces to the rod string.

6 Claims, 3 Drawing Sheets

METHOD AND APPARATUS FOR REMOVING TUBERCULATION FROM SANITARY WATER PIPELINES

This application claims priority of U.S. provisional application No. 60/801,367, filed May 18, 2006.

TECHNICAL FIELD

The invention related to an apparatus and method for removing tuberculation from sanitary water pipelines without contamination of the carried water supply.

BACKGROUND OF THE INVENTION

Through field experience in pipe bursting of cast iron water pipes, it has become clear that severely tuberculated pipes are normal. Tuberculation is a buildup on the interior wall of the pipe. The buildup is mineral in composition, and is a component dissolved in what is termed 'hard water'. The buildup is structural rather than granular in form and is firmly attached to the wall of the pipe. It can and regularly does become significant enough to cause flow restriction due to the loss of cross sectional area. Homeowners know the buildup as lime, and there are caustic products available to remove the buildup without need for mechanical attack. While the buildup may not create any issues for daily consumer use, water pipes are sized for fire service requirements, not a common use, but a critically important need. With the tuberculation cutting maximum flow rates, the fire department may not get enough water in an emergency to serve their needs.

A very workable solution is to replace the internally encrusted pipe with a new HDPE (High Density Polyethylene) pipe using pipe bursting. This pipe is impervious to corrosion and is generally not susceptible to mineral deposits. As an alternative to replacement, the pipe owner may opt for a maintenance program, specifically removal of the deposits and potentially a follow-up process to line the pipe. This program can not be accomplished safely with the use of chemicals as they are caustic. Residual chemicals, loose deposits and water with unpleasant taste are not acceptable to the consumer, therefore a more elegant and palatable solution must be found. The present invention addresses that need.

It is a purpose of this invention to bring to market a method that removes the buildup, conveys it out of the pipe, and leaves the pipe in a sanitary condition. Upon completion the pipe may be reinstated, or more conservatively tested for sanitary condition before being returned to service. Additionally, the pipe may be lined with a product such as Cempipe before reinstatement.

SUMMARY OF THE INVENTION

A method of cleaning a tuberculated water line according to the invention includes steps of selecting a section of water line to be cleaned, introducing a rotary cleaning tool mounted on a drill string into the water line section at its proximal end, rotating the cleaning tool and advancing it towards the distal end of the section in a manner effective to remove buildup from the inside of the line, removing water and particulates from the inside of the water line section, and then withdrawing the cleaning tool and drill string from the water line section, after which the pipe is restored.

An apparatus for cleaning a tuberculated sanitary water line according to the invention includes a drilling machine, a drill string comprising a series of hollow rods connected end to end extendable into the water line, the hollow rods forming a flow channel in the drill string, a rotary cleaning tool mounted on a distal end of the drill string, the tool having a front cutting face with a flow opening therein which is in communication with the flow channel in the drill string, and a discharge conduit connected to the flow channel of the drill string for discharge of liquid flowing out of the water line. The drilling machine is preferably a horizontal directional drilling machine.

A preferred method for removing pipe tuberculation of the invention includes the initial step of preparing an access point in the existing pipe, such as by digging to the pipe and sawing a section from the pipe or creating an access port. The section of the pipeline to have its tuberculation removed is isolated by closing valves or creating another access point and sealing the end. Then, a reaming tool is introduced to the interior of the pipe. The reaming tool is attached to a hollow rod string capable of producing moderate thrust and pullback force, and must also produce sufficient torque when rotated. A horizontal directional drilling or "HDD" machine on the surface or in a pit dug out for this purpose applies the aforementioned forces to the rod string.

Upon the tool entering the pipe, water flow is induced at all service laterals and if desired, the far end of the pipe. Water flow through the services is facilitated by creating temporary hookups to the adjacent building's plumbing system. These hookups, known as 'temps', are well known in the industry. The tool is rotated by turning the rod string and feeding the tool forward simultaneously. The shape of the tool is designed to shear or break the mineral deposits from the pipe wall.

As flow is introduced in the pipe, the flow will exit the pipe by entering the hollow rod and flowing back to the machine. The machine must be configured to discharge the water. The cutting action of the bit will put granulated mineral into the water flow stream. With the bit designed to break the mineral into small pieces, the mineral will be swept along by the water flow as it moves to the machine.

At the machine, the discharge may be filtered by a screen or put into a tank for settlement of the minerals. The waste water, now stripped of minerals can be put into a storm or sanitary sewer. As the flow may be in the range of 10 gallons per minute, and the feed rate may be 1 foot per minute, water usage can become considerable. For the example, cleaning a 300 foot stretch of pipe would use 3000 gallons.

Constant flow of sanitary water through the pipe during the reaming step maintains the sanitary condition of the pipe and ensures that loose mineral is not deposited in lateral connections or other features. This reverse flow concept to maintain sanitary conditions requires that the tools and the outside of the rods be introduced in a sanitary condition. Tooling is often sanitized for use on water systems by swabbing or spraying it with a weak chlorine solution, and such may be done as needed in the present invention. Additionally, the tool needs to be designed and sized to the inside diameter of the pipe so as to minimize leakage past the tool during operation and maximize the amount of mineral removal. Anti seize compound often used to lubricate rod joints should be FDA food grade approved.

According to an alternative form of the invention, it is possible to perform this method using a cutting tool were designed to pass the material behind the cutting edges or face, so that the flow carries the spoil toward the point of rod entry. The weakness of this approach is the slow water velocity, giving the likelihood of material dropping form the flow stream and building up behind the tool, possibly causing the tool and rods to become stuck. Secondly, the sanitary condition is at risk due to the large volume of newly broken material being passed over a great distance. These and other aspects of the invention are discussed in the detailed description that follows.

BRIEF DESCRIPTION OF THE DRAWINGS

The invention will hereafter be described with reference to the accompanying drawings, wherein like numerals denote like elements, and wherein.

DETAILED DESCRIPTION

Figure 1:
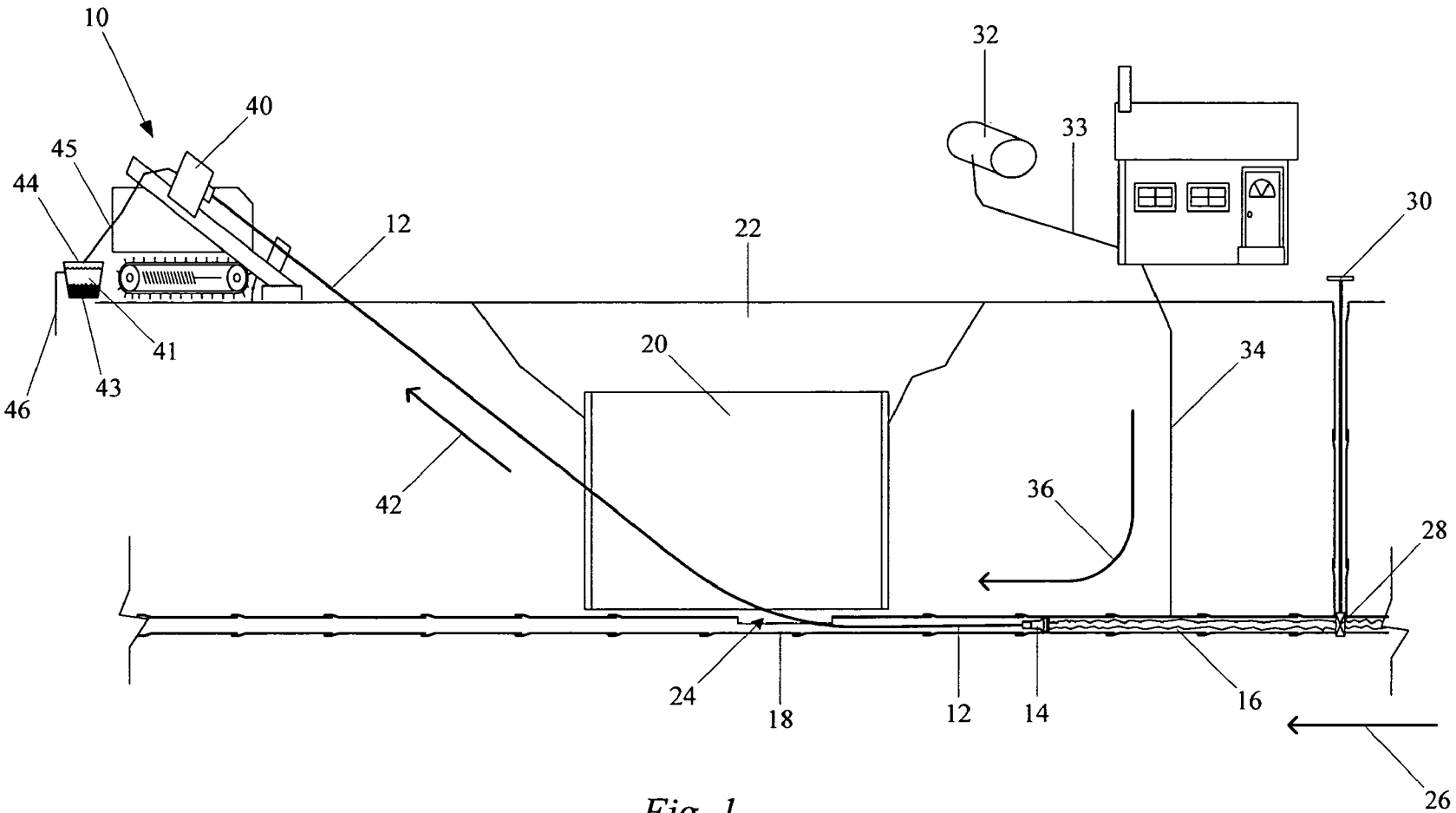
FIG. 1 is a schematic view of an apparatus according to the invention including apparatus for removing tuberculation from sanitary water pipelines attached to a hollow drill string rod, deployed by a directional drill machine into a sanitary water pipeline.
Figure 2:
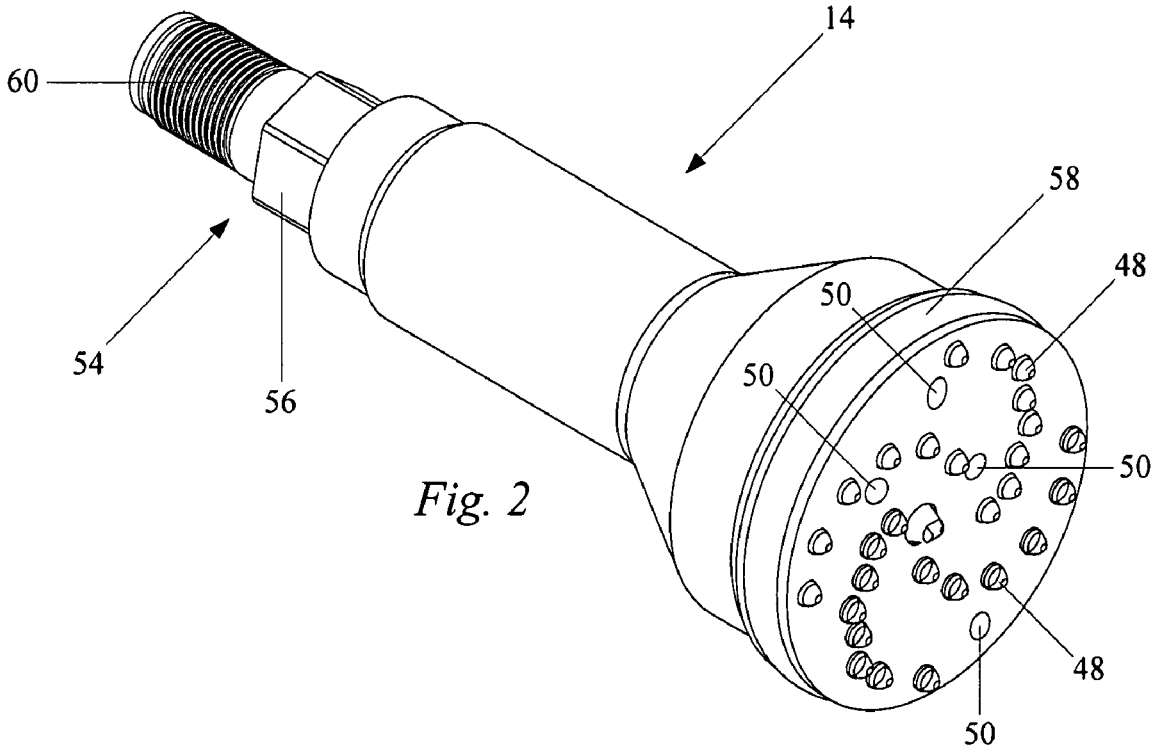
FIG. 2 is a perspective view of the tuberculant reaming tool of FIG. 1.
Figure 3:
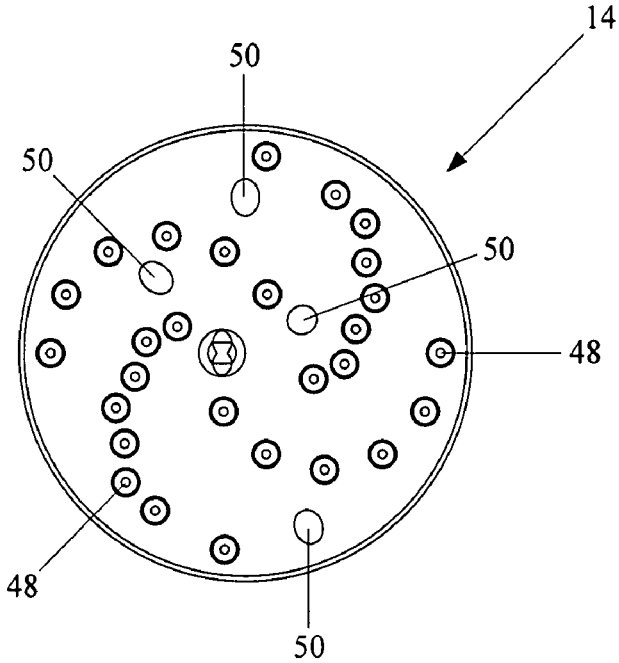
FIG. 3 is an end view of the tuberculant reaming tool of FIG. 1.
Figure 4:
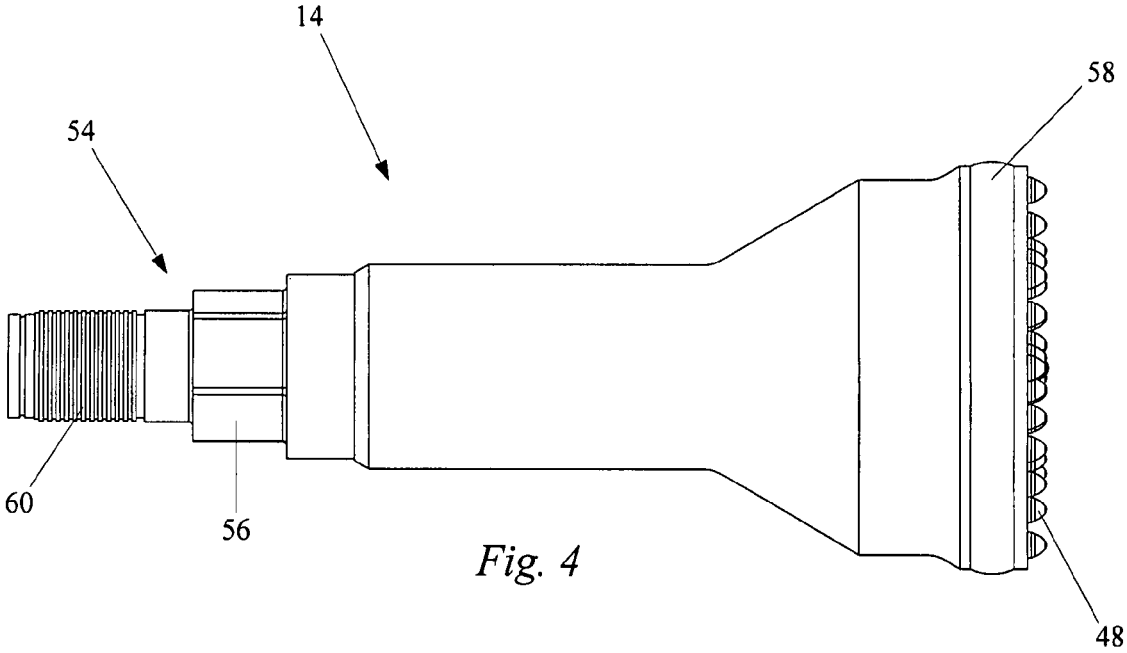
FIG. 4 is a side view of the tuberculant reaming tool of FIG. 1.
Figure 5:
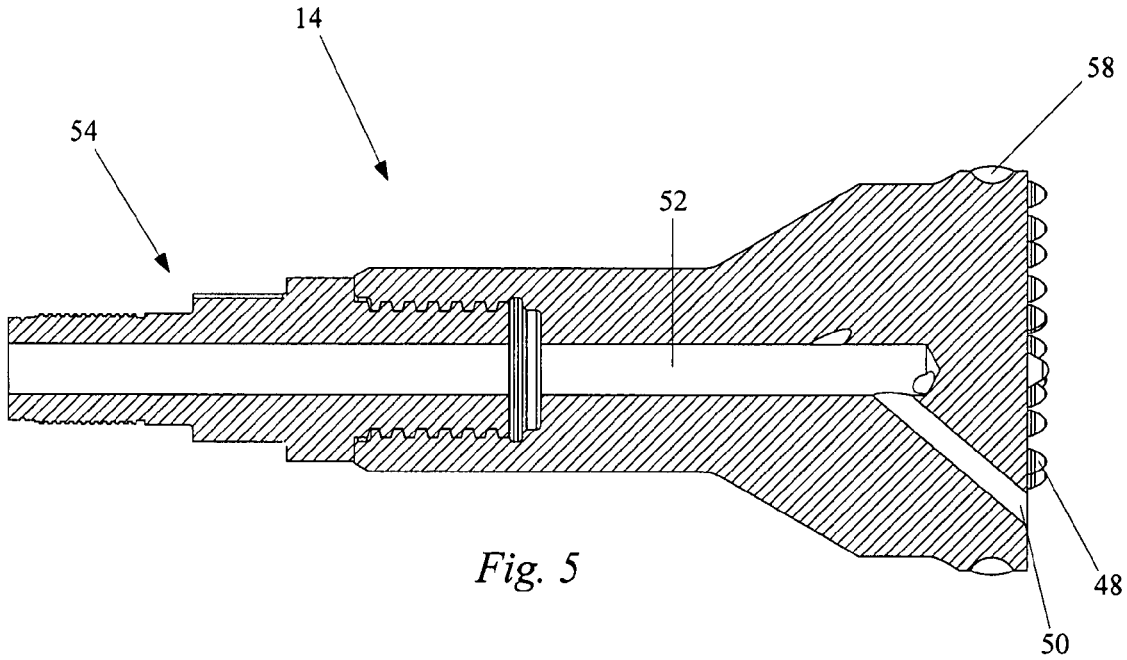
FIG. 5 is a lengthwise sectional view of the tuberculant reaming tool of FIG. 1.

Referring to FIG. 1, an apparatus for removing tuberculation from sanitary water pipelines according to the invention is designed for use with a horizontal directional drilling (HDD) machine 10. Deployed from drill rod spindle 40 is a hollow drill string rod 12 with a tuberculant reaming tool 14 at the terminal end. Hollow drill string rod 12 and tuberculant reaming tool 14 are directed into sanitary water pipeline 18 through a shorebox 20 placed at the bottom of an excavation 22. Shorebox 20 ensures the tuberculant reaming tool 14 and hollow drill string rod 12 are in sanitary conditions when they enter pipe access port 24. Tooling 14 may be sanitized for use on water systems by swabbing or spraying it with a weak chlorine solution. A worker in the shorebox 20 can apply the sanitizing solution to the rod string 12 as it enters the pipe. The reaming tool 14 should be designed and sized to the inside diameter of the pipeline 18 so as to minimize leakage past the tool during operation and maximize the amount of mineral removal. As noted above the anti-seize compound often used to lubricate drill string rod joints should be FDA food grade approved.

(HDD) machine 10 is capable of turning hollow drill string rod 12 with sufficient torque to permit attached tuberculant reaming tool 14 to remove tuberculated buildup 16 from sanitary water pipeline 18. The diameter of reaming tool 14 must be closely matched to the interior diameter of pipeline 18 to permit this reaming action. Hollow drill string rod 12 rotates rapidly while it pushes reaming tool 14 along the interior of pipeline 18, thereby removing tuberculated buildup 16 through this reaming action.

To prevent contamination of the sanitary water supply by tuberculated buildup 16 dislodged from sanitary water pipeline 18 by the reaming action of tuberculant reaming tool 14, normal water current (in direction 26) through pipeline 18 may be halted by means of shutoff valve 28 operated by valve control 30. A temporary water source 32 can then be introduced which is connected to a lateral service connection 34 through temporary water line 33, which provides an alternative water current in direction 36 into pipeline 18 during reaming. As the reaming action occurs, reaming tool 14 and hollow drill string rod 12 are pushed against the flow of alternative water current 36 as they are pushed along the interior of pipeline 18.

Because reaming tool 14 shares a similar diameter to the interior of pipeline 18, the alternative water current 36 is forced to flow up hollow drill string rod 12, carrying the tuberculated buildup 16 dislodged from pipeline 18 by reaming tool 14 with it in the form of granulated tuberculant 43. The waste product flow 42 is carried up hollow drill string rod 12 to (HDD) machine 10. The drill rod spindle 40 on (HDD) machine 10 is modified to discharge the waste water 41 and granulated tuberculant 43 through a hose 45 into a settling tank 44, where the granulated tuberculant 43 is filtered from the waste water 41. At this point, the waste water 41 is relatively clear and may be discharged to a sewer or water runoff path from settling tank 44 through discharge path 46.

Referring now to FIGS. 2-5, the tuberculant reaming tool 14 of FIG. 1 is depicted. The body of the reaming tool 14 is roughly cylindrical and tapers from front to back. The forward "head" of the device is the widest portion, and the diameter of this is fit to match the inside diameter of pipes it will be cleaning. Around this head is a ring of wear metal 58 designed to roughly seal against the inside of the pipeline 18. Inset in the face of the device are spirals of carbide teeth 48 or similar cutting devices designed to chew through tuberculated buildup 16 when the device is being rotated rapidly by the hollow drill string rod 12.

On the face of the device are a set of water intake ports 50. These water intake ports 50 converge radially to the center of the cylindrical bit body into a through a central flow passage 52 which extends back through the device to the mounting adapter 54, which attaches to the terminal end of hollow drill string rod 12. Mounting adapter 54 is a two piece device with a threaded joint 60 to "screw in" to a female receptacle on the terminal end of hollow drill string rod 12, and a hexagonal locking mechanism 56 to hold it secure. The through passage 52 extends through to the hollow cavity in hollow drill string rod 12, enabling water flow from the tuberculant reaming tool 14 to the hollow drill string rod 12.

It will be understood that the foregoing description is of preferred exemplary embodiments of the invention, and that the invention is not limited to the specific forms described and illustrated. For example, in may be sufficient to rely on back pressure created by the forward movement of the tool 14 to force the removed tuberculant back through the openings 50 in the drill face, with or without the closing of the pipeline at valve 28. However, closing the pipeline at the end of the run and setting up a counterflow of sanitary water in direction 36 is preferred and is more likely to provide optimum results. These and other modifications may be made in without departing from the spirit of the invention.

The invention claimed is:

1. A method of cleaning a tuberculated sanitary water line, comprising:

selecting a section of sanitary water line to be cleaned;

flowing sanitary water into the section of the sanitary water line;

introducing a rotary cleaning tool which is a drill bit having a circular side profile which fits closely with the sanitary water line, which bit is mounted on a hollow drill string having a flow channel therein into the sanitary water line section at its proximal end, which drill string and cleaning tool are in a sanitary condition;

rotating the cleaning tool and advancing it towards the distal end of the section in a manner effective to remove buildup from the inside of the line;

drawing water and particulates removed from the inside of the sanitary water line section through an opening in a front face of the bit, which opening communicates with the flow channel in the drill string;

ejecting the water and particulates from the drill string;

maintaining flow of sanitary water into the water line section to one or more locations ahead of the drill bit;

then withdrawing the cleaning tool and drill string from the sanitary water line section wherein the sanitary water line remains in a sanitary condition during the steps of the cleaning method.

2. The method of claim 1, wherein the step of introducing the rotary cleaning tool into the sanitary water line section comprises creating an opening in the side of the sanitary water line section through which the cleaning tool enters the section at its proximal end, and sanitizing the drill string as it enters the opening in the line section.

3. The method of claim 1, wherein the step of flowing water comprises partially opening a valve located at a remote end of the section and flowing sanitary water under pressure through the partially open valve.

4. The method of claim 1, wherein the step of flowing water comprises flowing sanitary water into the pipe section through service laterals connected to the line section.

5. The method of claim 1, wherein the cleaning tool comprises a toothed bit having passages in its front face providing the opening in the cleaning tool.

6. The method of claim 1, further comprising maintaining a substantially water tight seal around the outside of the bit of the rotary cleaning tool.

* * * * *